United States Patent [19]

Martin

[11] 4,174,275

[45] Nov. 13, 1979

[54] HYDROCYCLONE APPARATUS AND METHOD FOR UNDERFLOW DENSITY CONTROL

[75] Inventor: David L. Martin, Woodside, Calif.

[73] Assignee: Krebs Engineers, Menlo Park, Calif.

[21] Appl. No.: 871,391

[22] Filed: Jan. 23, 1978

[51] Int. Cl.[2] ..... B04C 5/15

[52] U.S. Cl. ..... 209/211; 137/849

[58] Field of Search ..... 209/211, 144, 496, 494; 210/512 R, 512 M, 113; 222/494, 490, 212, 213, 527, 529; 137/849

[56] References Cited

U.S. PATENT DOCUMENTS

| | | | |
|---|---|---|---|
| 754,732 | 3/1904 | Allen | 210/113 |
| 1,155,473 | 10/1915 | Dull | 210/113 |
| 3,034,647 | 5/1962 | Giesse | 209/211 X |
| 3,213,879 | 10/1965 | Thompson | 137/527.4 |
| 3,307,336 | 3/1967 | Dewsberry | 55/337 |
| 3,437,205 | 4/1969 | Condolios | 210/512 R X |
| 3,575,521 | 4/1971 | Porter et al. | 137/849 X |
| 3,589,107 | 6/1971 | Vines | 55/432 |
| 3,923,210 | 12/1975 | Jackson | 222/494 |
| 3,929,642 | 12/1975 | Ennis et al. | 210/113 |

*Primary Examiner*—Ralph J. Hill

*Attorney, Agent, or Firm*—Flehr, Hohbach, Test, Albritton & Herbert

[57] ABSTRACT

Hydrocyclone apparatus having means for controlling the gravity of the discharging underflow. The means consists of a plurality of sectors formed of resilient material which are mounted below the apex opening of the hydrocyclone whereby when relaxed the apexes of the sectors terminate at the hydrocyclone axis and the side edges of each sector are in juxtaposition with adjacent sectors. When the hydrocyclone is in operation the discharging underflow material deflects the sectors downwardly and so controls the underflow as to maintain its density substantially constant irrespective of changes in the density of the slurry supplied to the inlet. Preferably the construction is such that an underflow shield is provided about the lower end of the hydrocyclone apex. The invention also includes the method employed by use of the apparatus.

6 Claims, 7 Drawing Figures

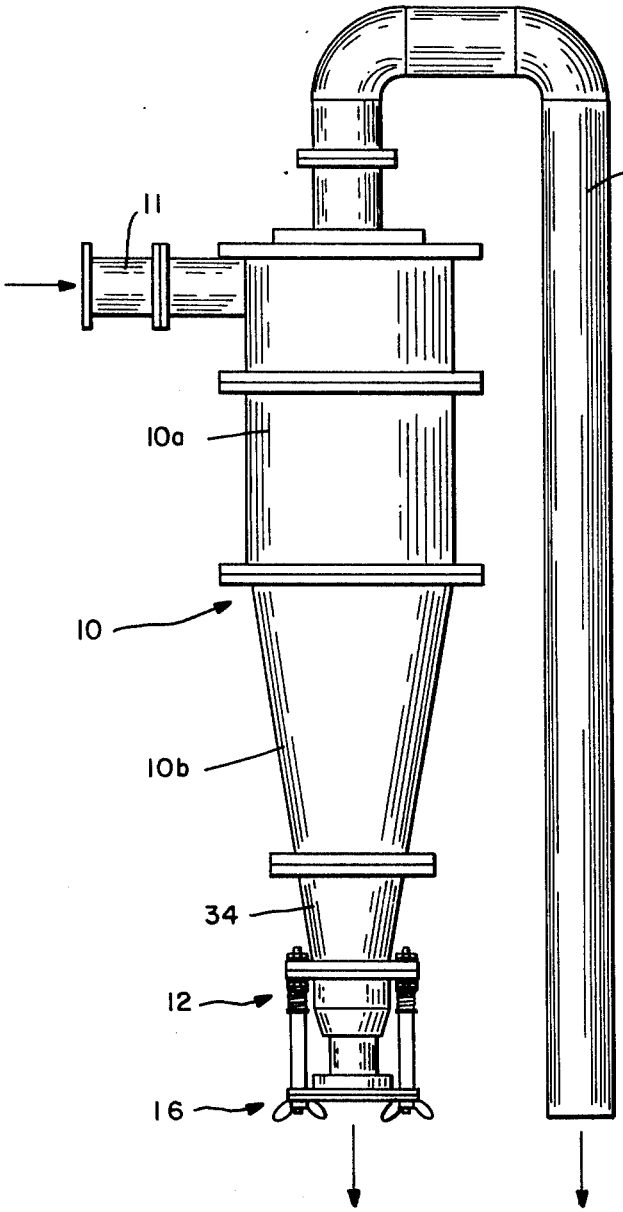
FIG.—1
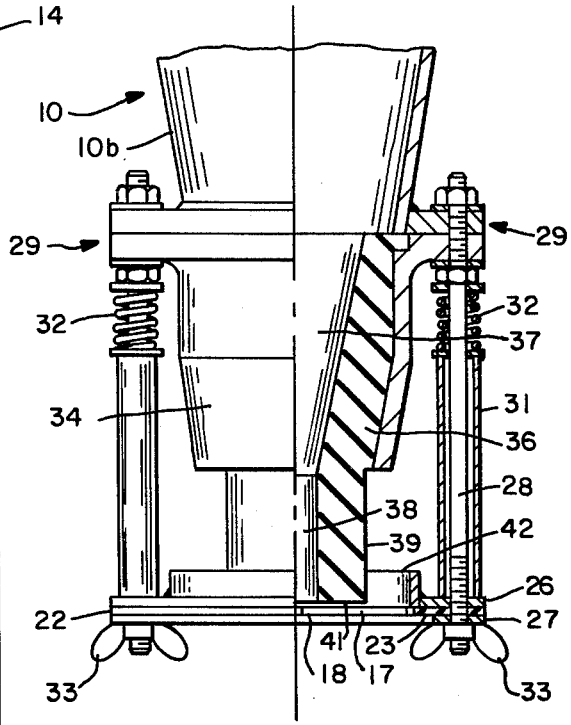
FIG.—2
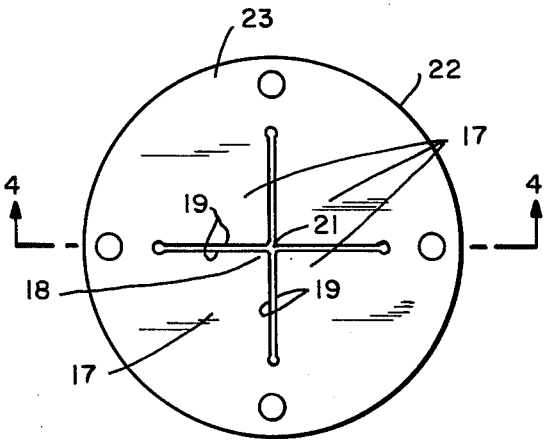
FIG.—3
FIG.—4
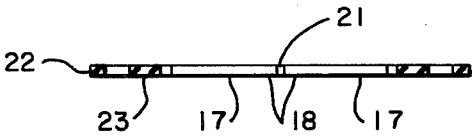

HYDROCYCLONE APPARATUS AND METHOD FOR UNDERFLOW DENSITY CONTROL

REFERENCE TO RELATED APPLICATION

Reference is made to copending application Ser. No. 935,525 filed Aug. 21, 1978, entitled "Hydrocyclone Apparatus and Method for Underflow Control", which is a continuation-in-part of this application.

BACKGROUND OF THE INVENTION

Hydrocyclones are commonly used in many industries for carrying out concentrating, clarifying and classifying operations on various mineral slurries or pulps and liquids containing undissolved solid particles. Briefly, a hydrocyclone consists of a separating chamber that is annular in section and which has a conical portion having an underflow discharge opening at its lower apex end. The chamber also has means forming an inlet opening connected tangentially with the upper portion of the chamber and means forming an overflow outlet which communicates with a vortex finder disposed axially within the chamber. When in operation, the feed is supplied under pressure to the inlet, and swirling movement of the body of material within the chamber causes centrifugal separation of solids with the separated material being discharged as an underflow from the apex end of the chamber, and the overflow being discharged through the vortex finder and the overflow outlet. For concentrating or where it is desired to provide a clarified overflow, the operation is such that substantially all of the solid material of the feed is discharged with the underflow. For classification, heavier solids are discharged in the underflow and lighter solids in the overflow.

A common problem in the operation of hydrocyclones has been the maintenance of a constant high density (solids-to-liquid ratio) underflow material while operating under conditions where the cyclone feed density fluctuates over wide limits. Such fluctuations are experienced for example in mineral slurries produced by continuously operating product preparation circuits. By way of example, in instances where a sand-gravel preparation circuit is supplying feed to a hydrocyclone, the density of the feed may vary from less than 1% to more than 25%, with the result that the underflow is subject to corresponding fluctuations in density. Such variations may cause serious resulting problems in the handling and further processing of the underflow.

In the past various methods and types of equipment have been employed in an effort to control the density of the underflow. For example, in some instances variations in density of the underflow have been detected by various devices, such as those making use of gamma ray radiation that is projected through a stream of the material, and the detecting device connected to control the circuit which is preparing the feed. Such equipment is relatively expensive and the control provided is not as accurate as is frequently desired, due to deficiencies in the detecting devices, inability to effectively control the preparation circuit, or both. Less elaborate devices that have been employed include collapsible tubing of resilient material, flap valves, and counterbalanced piping arrangements applied to the apex of the hydrocyclone to effect some control over the discharge of underflow in accordance with changes in density. Use of such devices has resulted in increased maintenance requirements of the hydrocyclone circuit, cyclone choking or plugging, and aberrant performance. In addition, such devices do not provide maintenance of the underflow density within the flow limits frequently desired.

SUMMARY OF THE INVENTION AND OBJECTS

This invention relates generally to hydrocyclone apparatus and methods for controlling the density of the discharging underflow.

In general, it is an object of the invention to provide a hydrocyclone apparatus and method which will enable control of the underflow density within relatively close limits, irrespective of relatively wide variations in density of the feed material.

Another object is to provide an apparatus and method which is relatively simple and inexpensive, and which can be incorporated with hydrocyclones of conventional construction.

Another object is to provide an apparatus and method which is relatively free of maintenance requirements, which avoids cyclone choking or plugging, and which in general avoids aberrant performance of the hydrocyclone.

In general, the invention makes use of a hydrocyclone having a separating chamber that is annular in section with a lower conical shaped portion having an opening at its lower apex end for discharge of an underflow containing separated solids. The chamber is provided with an inlet opening connected tangentially with the upper portion of the chamber, and an overflow outlet communicating with an inner vortex finder disposed axially of the chamber. The control means consists of a plurality of sectors made of resilient material, the base portions of the sectors being secured to a mounting which serves to position the sectors whereby when they are relaxed they are disposed below and in close proximity with the apex opening of the hydrocyclone, and also whereby the apex of each sector is substantially in alignment with the axis of the chamber with its side edges extending radially from the axis. The sectors are deflected downwardly by discharging underflow material with the discharge being controlled in such a manner that the density of the discharging material is maintained substantially constant. Preferably shield means is employed which surrounds the apex end of the hydrocyclone and serves to retain underflow material which discharges outwardly between the lower apex end of the hydrocyclone and the sectors. The invention also includes the method employed when the apparatus is in operation.

Additional objects and features of the invention will appear from the following description in which the preferred embodiment has been disclosed in detail in conjunction with the accompanying drawing.

BRIEF DESCRIPTION OF THE DRAWING

FIG. 1 is a side elevational view illustrating a conventional hydrocyclone equipped with control means according to the present invention.

FIG. 2 is a half-section of the control means shown in FIG. 1.

FIG. 3 is a plan view showing the configuration of the sectors incorporated in the apparatus of FIG. 2.

FIG. 4 is a cross-sectional view taken along the line 4—4 of FIG. 3.

DESCRIPTION OF THE PREFERRED EMBODIMENT

Figure 5:
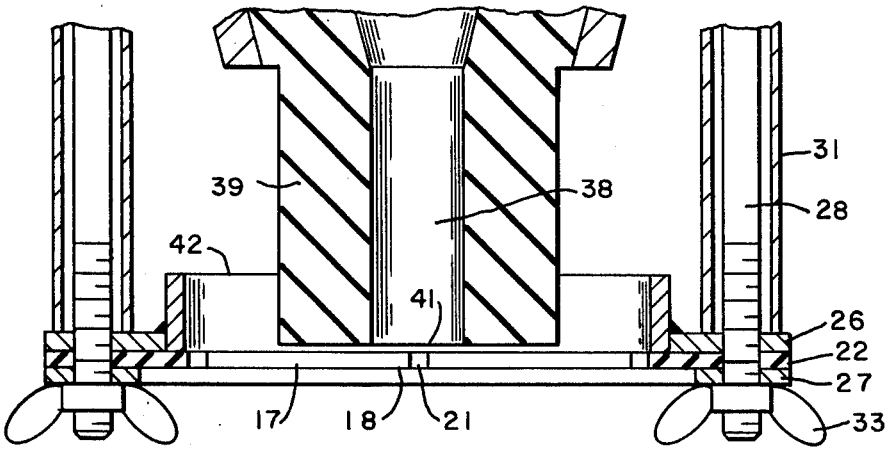
FIGS. 5, 6 and 7 are similar detail views in section illustrating three different positions of the sectors.

The hydrocyclone apparatus shown in FIG. 1 consists of a separating chamber 10, the upper portion 10*a* of which is connected tangentially to the inlet 11, and the lower portion 10*b* being conical and terminating in the apex 12. The interior of the chamber is provided with the usual vortex finder 13, which is aligned with the axis of the chamber and which connects with the outlet pipe 14. When feed is pumped through the inlet the body of material within the chamber is caused to swirl about the central axis, thus creating separating forces resulting in discharge of an underflow through the apex 12 and an overflow through the vortex finder 13 and outlet 14. The overflow or outlet piping 14 generally extends to a level below the apex 12 to enhance its suction effect.

The control means incorporated with the hydrocyclone is designated generally at 16 in FIG. 1 and is shown in detail in FIG. 2. It consists of a plurality of sectors 17 shown in plan in FIG. 3. They are made of suitable synthetic rubber or elastomer, having good resilience and recovery characteristics. The apex tip 18 of each sector is disposed relatively close to the central longitudinal axis of the hydrocyclone chamber, and the side edges 19 of each sector extend radially from the central axis and are in relatively close juxtaposition with the corresponding side edges of adjacent sectors. In a typical instance the clearance between the side edges 19 may be about 1/32nd of an inch. The tip ends 18 of the sectors are so formed as to provide a small central relief hole 21. In a typical instance this may be of the order of ⅛ inch in diameter. In practice, the sectors 17 have been made integral with a disk 22 made of the same synthetic rubber or elastomer, with the dimensions being such that there is a surrounding annulus 23 to which the base portions of the sectors are integrally secured.

When the sectors 17 are relaxed, they are in a common plane as shown in FIG. 4. However, when the sectors are deflected downwardly a substantial effective cross-sectional flow area is provided for discharge of underflow, the size of the flow area being dependent upon the extent of deflection.

The disk 22 is mounted in the manner shown in FIG. 2. The annulus or outer margin 23 of the disk is clamped between the upper and lower metal rings 26 and 27. Spacing rods 28 have their upper ends fixed to the body of the hydrocyclone, as for example, by utilizing their upper ends as bolts for clamping the two flanges of the coupling connection 29. The lower threaded ends of the rods 28 extend through aligned openings in the clamping rings 26 and 27 and the outer margin 23 of the disk 22. The rods 28 extend through sleeves 31 which have their lower ends engaging the ring 26, and the upper ends engaged by the compression springs 32. The lower threaded ends of the rods 28 are provided with wing nuts 33 which serve as means for adjusting the position of the disk 22, together with the rings 26 and 27, relative to the lower end of the hydrocyclone.

In the construction illustrated, the apex end of the hydrocyclone is shown consisting of the lower body section 34 which is secured to the body section immediately above the same by the flanged coupling 29, and which is provided with a liner 36 made of material capable of withstanding the abrasive action of solid particles, such as a suitable synthetic rubber or elastomer. The upper portion 37 of the opening through the liner may be conical as illustrated, and the lower portion 38 provided by the liner extension 39 may be substantially cylindrical The lower end face 41 of the liner is coincident with a plane at right angles to the axis of the hydrocyclone. In practice, it has been desirable to adjust the mounting whereby when the sectors 17 are relaxed and in a common plane, their upper surfaces are in close proximity with the lower face 41 of the liner. In a typical instance this spacing may be of the order of 1/16th of an inch, although in some instances it may be desirable to have the lower face of the liner substantially in contact with the upper surface of the relaxed sectors.

Figure 6:
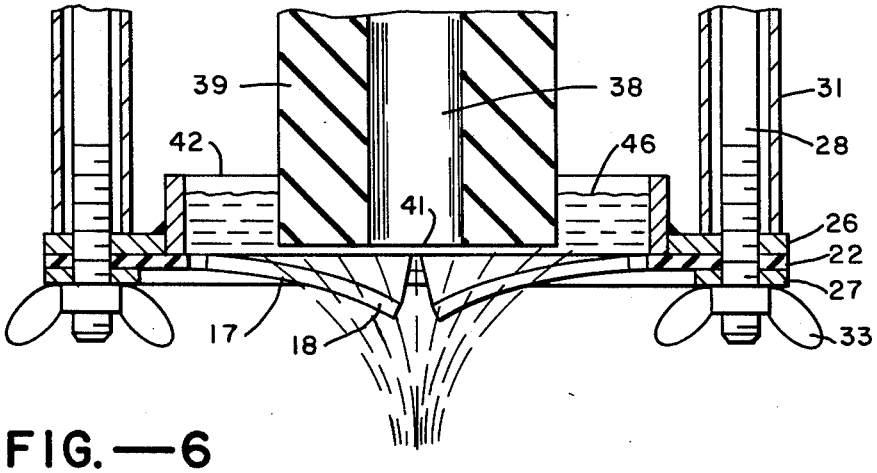
Figure 7:
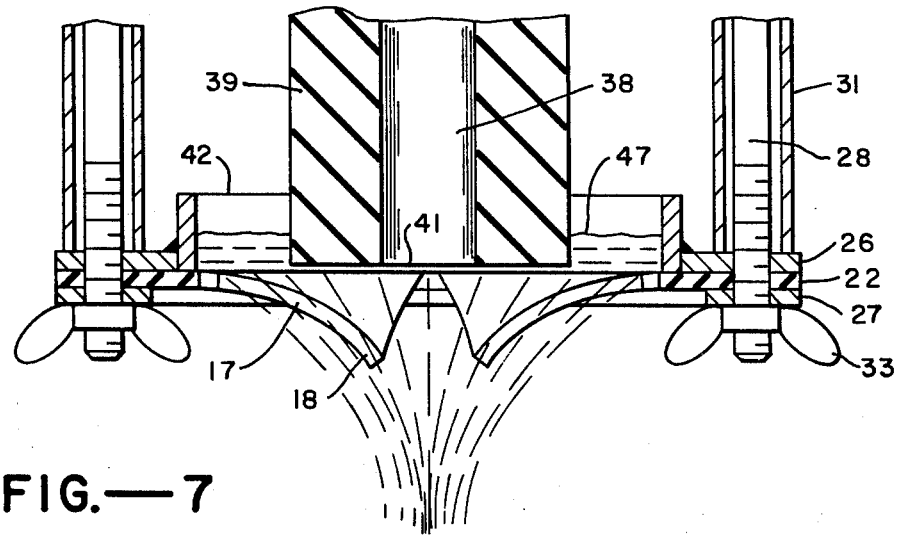

In addition to the parts described above, it is desirable to provide a shield 42 which may be in the form of a ring secured to or formed integral with the clamping ring 26. This shield extends upwardly and surrounds the lower end of the hydrocyclone liner, and is spaced radially from the same. As will be presently explained, it serves to retain underflow material which may discharge outwardly between the liner surface 41 and the underlying sectors Operation of the apparatus and the method involved in such operation can be explained by reference to FIGS. 5, 6 and 7. FIG. 5 represents a condition in which no feed material is being supplied to the hydrocyclone chamber, and therefore no underflow is being separated. It will be noted that the sectors 17 are relaxed and disposed in a common plane, and that the upper surfaces of the sectors are in close proximity with the lower end surface 41 of the apex liner. FIG. 6 represents an operating condition in which feed material is being pumped into the upper end of the hydrocyclone, with the underflow applying downward thrust to the sectors 17. The extent of this downward thrust is determined largely by the density of the underflow material. Assuming that the density of the feed remains substantially constant, then under normal conditions the density of the underflow remains constant and the downward deflection of the sectors 17 will remain substantially the same. However, assuming that the density of the feed increases with a resulting increase in the density of the underflow, the downward thrust upon the sectors increases, with the result that they are deflected downwardly to a position such as illustrated in FIG. 7.

The control means described above is most effective in maintaining the underflow substantially constant, irrespective of changes in the density of the feed, when the overflow outlet is capable of exerting some suction or siphoning action. When the feed density is minimum, the control means exerts substantial restriction to the underflow discharge by partially blocking off the apex opening. This has the effect of increasing the amount of overflow liquid being discharged through the outlet while the heavier solids of the feed continue to report to the underflow in the apex portion of the separating chamber, with the overflow discharge being aided by the suction or siphoning action of the piping 14.

The shield 42 aids in maintaining the desired density control and proper operation of the hydrocyclone. During operation it permits maintenance of a gap between the lower end 41 and the sectors, while at the same time maintaining the lower end within a pool of slurry, particularly under low rates of underflow discharge. FIG. 6 shows the slurry level within the shield at 46, and in FIG. 7 it is indicated at 47. Under such conditions an approximate seal is formed to block or minimize entry of air into the apex. The restriction provided by the sectors and also the approximate seal established as just described minimizes introduction of air into the apex end portion of the hydrocyclone, thereby contributing to the maintenance of a normal air core extending axially of the hydrocyclone separating chamber.

In laboratory testing of the invention it has been found possible to control the underflow density to within a variation of 1% by weight for density variations of feed ranging from 1 to 25% solids (by weight).

As previously mentioned, the hydrocyclone may be of conventional construction except for the control means and its manner of application. The design of the hydrocyclone should be such that there is a proper ratio of vortex finder diameter to the diameter of the apex opening 38, as for example ratios ranging from 2:1 to 3:1.

In addition to providing a control serving to maintain the density of the underflow substantially constant irrespective of changes in the density of the feed, the invention serves to maintain the underflow density substantiaLly constant for substantial changes in the rate of feed. This may occur in various hydrocyclone installations. For example, in instances where the feed is pumped to a manifold to which a plurality of hydrocyclones are connected, the rate of feed to particular ones of the hydrocyclones may vary. Also in some installations the pumping means may be subject to variations in the rate of discharge for purposes of control.

In general, the invention is simple in construction and operation. The thrust of the underflow upon the sectors is dependent upon the density of the underflow in the apex end portion of the hydrocyclone, rather than a volume of underflow in an apparatus which receives underflow from the hydrocyclone. In operation it is relatively free of plugging, and any oversize solids are readily passed between the sectors without materially affecting the control of density.

What is claimed is:

1. A hydrocyclone which when in upright position having a separating chamber that is annular in section with a lower conical shaped portion having an opening at its lower apex end, the chamber having means forming an inlet connected tangentially with the upper portion of the chamber and also having means forming an overflow outlet communicating with a vortex finder disposed axially of the chamber; the improvement comprising a plurality of sectors made of resilient material, mounting means to which the base portions of the sectors are secured, the mounting means serving to so position the sectors whereby when the sectors are relaxed they extend inwardly toward said axis in close proximity with the apex opening of the hydrocyclone, the apex of each sector being substantially aligned with the axis of the chamber and with the side edges of the sectors extending radially from the axis, the side edges of each sector being in juxtaposition with the side edges of the adjacent sectors, said sectors being flexed downwardly by discharging underflow material overlying the same when the hydrocyclone is in operation, said sectors serving to control discharge of underflow material to maintain the density of the underflow material substantially constant, irrespective of changes in the density of the feed material being supplied to the inlet, and shield means forming a wall extending upwardly from an upper face of said mounting means and surrounding the apex end of the hydrocyclone and radially spaced therefrom for retaining underflow material discharging outwardly between the lower end face of the apex opening of the hydrocyclone and the sectors.

2. A hydrocyclone as in claim 1 in which the sectors are integral with an annulus of resilient material.

3. A hydrocyclone as in claim 1 in which the shield means forms a wall extending upwardly from the upper face of said annulus.

4. A hydrocyclone as in claim 1 in which the mounting means is adjustable to adjust the spacing between the sectors and the apex end of the hydrocyclone.

5. A hydrocyclone as in claim 1 in which the mounting means together with said shield means is adjustable to adjust the spacing between the sectors and the apex end of the hydrocyclone.

6. A hydrocyclone as in claim 1 in which the sectors when relaxed are in a common plane extending at right angles to the axis of the hydrocyclone.

* * * * *